US007877824B2

(12) United States Patent
Grant et al.

(10) Patent No.: US 7,877,824 B2
(45) Date of Patent: Feb. 1, 2011

(54) TELESCOPING SUPPORT BAR

(76) Inventors: Willie T. Grant, 4100 Churchill Dr., Birmingham, AL (US) 35213; Carolyn R. Grant, 4100 Churchill Dr., Birmingham, AL (US) 35213

( * ) Notice: Subject to any disclaimer, the term of this patent is extended or adjusted under 35 U.S.C. 154(b) by 325 days.

(21) Appl. No.: 12/045,389

(22) Filed: Mar. 10, 2008

(65) Prior Publication Data

US 2009/0223917 A1 Sep. 10, 2009

(51) Int. Cl.
*A47K 3/024* (2006.01)

(52) U.S. Cl. ..... 4/576.1; 4/577.1; 4/611

(58) Field of Classification Search ..... 211/123, 211/124, 175, 204, 206, 105.1, 105.3–105.6, 211/119.009, 119.011; 248/200.1, 298.1, 248/261, 316.8; 4/576.1, 577.1, 611
See application file for complete search history.

(56) References Cited

U.S. PATENT DOCUMENTS

| | | | | | |
|---|---|---|---|---|---|
| 772,829 | A | * | 10/1904 | Russell, Jr. | 211/105.4 |
| 1,356,454 | A | * | 10/1920 | Knight | 211/105.4 |
| 1,679,881 | A | * | 8/1928 | Simpson | 211/105.4 |
| 1,891,588 | A | * | 12/1932 | Claus | 410/151 |
| 1,951,660 | A | * | 3/1934 | Klaudt | 211/123 |
| 2,275,236 | A | * | 3/1942 | Shannon | 16/87.2 |
| 2,293,168 | A | * | 8/1942 | Pirone | 211/123 |
| 2,462,321 | A | * | 2/1949 | Holmes | 211/123 |
| 2,637,555 | A | * | 5/1953 | Klaudt | 482/40 |
| 3,333,808 | A | * | 8/1967 | Du Boff | 248/200.1 |
| 3,572,511 | A | * | 3/1971 | Triplett | 211/105.6 |
| 4,498,204 | A | * | 2/1985 | Warner | 4/559 |
| 4,662,591 | A | * | 5/1987 | Encontre | 248/188 |
| 4,895,471 | A | * | 1/1990 | Geltz et al. | 403/104 |
| 5,826,847 | A | * | 10/1998 | Warner et al. | 248/354.1 |
| 2004/0055980 | A1 | * | 3/2004 | Krieger et al. | 211/86.01 |

FOREIGN PATENT DOCUMENTS

| | | | | |
|---|---|---|---|---|
| CH | 625601 | A | * | 9/1981 |
| JP | 02055100 | A | * | 2/1990 |

* cited by examiner

*Primary Examiner*—Darnell M Jayne
*Assistant Examiner*—Stanton L Krycinski

(57) ABSTRACT

A telescoping support bar installed in a shower enclosure and similar facilities requires no mechanical wall fasteners. The support bar includes telescoping tubes with end retainers gripping walls of the enclosures. Length of the support bar is governed by fixed length spacer means and internal extensible means. Extensible means, having bearings movable along a rod, provides the lengthening and shortening of the support bar as the distance between the bearings is increased or decreased. This change in distance likewise changes the overall length of the support bar. With the retainers snug against the walls, one of the tubes, being rotatable, is turned in circular motion. This rotation is converted into an axial force along the bar causing the retainers to forcefully grip the walls, providing a rigid and strong bar installation.

2 Claims, 1 Drawing Sheet

TELESCOPING SUPPORT BAR

BACKGROUND OF THE INVENTION

U.S. patent application publication No. 2008/0222790 A1, published Sep. 18, 2008 sets forth a Bath and Shower Assist Means for use in a shower or bath and shower enclosure. The horizontal grip bar extending from wall to wall is the core of the invention. One of the shortcomings of the invention in the patent application is the necessity that each bar be custom made according to the dimension of the particular shower enclosure in which it will be installed. This requirement prevents mass production of the bath and shower assist means.

Also in patent application Ser. No. 11/684,611 sealing means are defined to be attached to the covering means that encapsulate the compression and tension elements that engage the wall faces of the shower enclosures. A stronger support system is provided if the sealing means also serves as bonding means between the tiles of the shower walls and the contact surfaces of the compression and tension means.

SUMMARY OF THE INVENTION

The present invention overcomes these shortcomings and other limitations by providing telescoping means that incorporate multiple tubes that are radially compatible and telescope from a minimum length to a maximum length bar. This variable feature in the length of the bar permits the same support bar to be used for a range of sizes of shower enclosures, generally eliminating the need to custom-cut a different length wall-to-wall bar for each facility.

The various components provide the variability in the bar length. External end retainers grip the parallel walls of the enclosure. One of the retainers attaches to an extremity of a rotatable tube in the support bar. This tube creates the axial force required for the retainers to grip the walls. At the opposite end of the support bar, the second retainer attaches to a smaller diameter tube that telescopes in and out of the larger diameter tube. The longitudinal void within the tubes is filled by a fixed length spacer means, which includes a tubular section with end bearings; and extensible means, comprising a rod encircled with movable bearings. Adjustment of the bearings, longitudinally on the rod, controls and sets the overall length of the support bar. As the distance between the bearings is increased or decreased the length of the support bar is likewise increased or decreased. With the retainers fitting snuggly between the walls, the rotatable bar is turned in a circular motion coercing the retainers to grip the walls forcefully, providing a rigid and strong installation. Thus the present invention provides for a variable length support bar that meets all of the requirements sought after.

One of the principal objectives of the present invention is to provide telescoping support means that can be easily assembled, installed, and removed without the use of mechanical fasteners.

Another objective is to provide telescoping support means with longitudinal adjustability to accommodate a range of shower and other facility dimensions thereby eliminating the need to custom-build each support bar.

Another objective is to provide a support bar having easy release means thereby giving it location mobility within an enclosure.

These and other objects and advantages of the invention will become apparent after considering the following detailed specification and accompanying drawing which cover a preferred embodiment wherein:

DETAILED DESCRIPTION OF A PREFERRED EMBODIMENT

Figure 1:
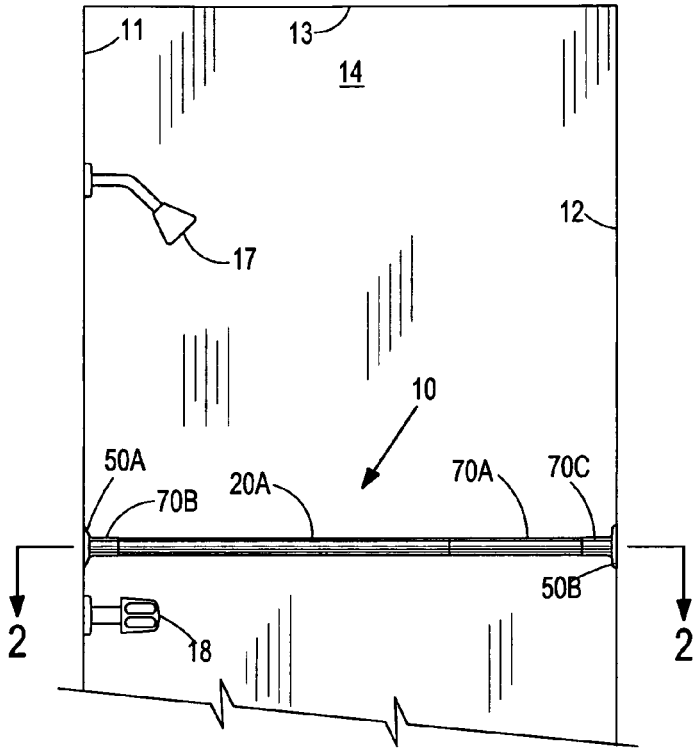
FIG. 1 is a partial elevation of a shower enclosure having a telescoping support bar installed.

Referring to the drawing more specifically, FIG. 1 references telescoping support bar 10 (hereafter called support bar) constructed according to the present invention for installation in shower enclosures or tub/shower facilities having walls 11, 12, and 14 and ceiling 13. Shown also in FIG. 1 are shower head 17 and faucet 18 attaching to said wall 11.

Figure 2:
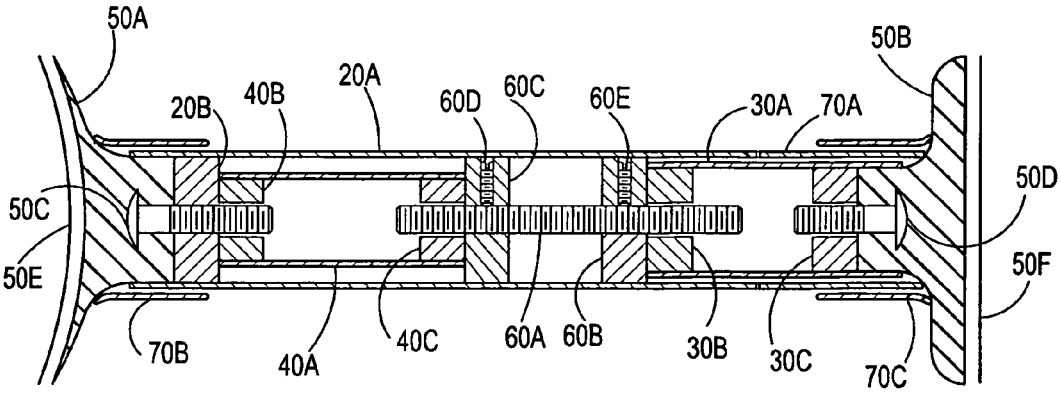
FIG. 2 is a cross-sectional view taken along line 2-2 of FIG. 1.

Referring to FIG. 2, said support bar comprises retaining means 50A and 50B with embedded studs 50C and 50D respectively. Support bar 10 incorporates rotatable means comprising larger diameter tube 20A with first bearing 20B. Tube 20A of rotatable means telescopes with a slightly smaller diameter tube 30A; said tube 30A translates longitudinally in and out of larger diameter tube 20A of rotatable means. Said tubes 20A and 30A connect to retainers 50A and 50B respectively through first bearing means 20B and fourth bearing means 30B and 30C respectively in FIG. 2. Tube 20A secures internally threaded first bearing 20B; threads of said bearing mating with external threads of stud 50C embedded in retainer 50A.

Retainers 50A and 50B consist of components constructed of compressible, pliable material; such components being on the order of suction cups, disks, or like means, said disks being covered with or constructed of described material; each said retainer capable of exhausting air trapped between its surface and the surface it engages; and said retainer forcefully gripping said surface through the influence of an axial force applied to said support bar. The external faces of retainers 50A and 50B have sealing means 50E and 50F respectively attached for the purpose of assisting in securing said retainers to the wall surface and sealing said faces against water intrusion. Said sealing means may be applied in the form of an adhesive or other means. Tube 30A and fourth bearings 30B and 30C in FIG. 2, cooperate with retainer 50B through a center hole in bearing 30C and the embedded stud 50D. Said fourth bearings 30B and 30C in tube 30A, and first bearing 20B in tube 20A are secured to their respective tubes by means of welds, screws or other anchorage compatible with the material employed.

Bearings 30B and 30C, seated in smaller diameter tube 30A, each encompass a smooth hole about the longitudinal axis. Said hole in bearing 30B accepts the projection of rod 60A; said hole in bearing 30C accepts stud 50D of retainer 50B. Said extensible means comprises said rod 60A and third bearings 60C and 60B; said bearings having securing means 60D and 60E of FIG. 2.

Enclosed within tube 20A of said rotatable means is tube 40A of spacer means securing second bearings 40B and 40C, one said bearing at each extremity of tube 40A. Bearings 40B and 40C each contain a smooth hole along the common longitudinal axis to accept the projection of stud 50C and rod 60A, neither bearing 40B nor 40C is rotatably influenced by the reception of stud 50C and rod 60A. Spacer means comprises tube 40A and bearings 40B and 40C. With bearings 40B and 40C secured to tube 40A, said spacer means has a fixed length within each support bar; said spacer means occupies the spatial cavity between bearing 20B of said rotatable means and bearing 60C of extensible means.

In applications where support bar 10 incorporates relatively smaller diameter tubular sections, tubes 20A, 30A, and 70A will dictate a corresponding size reduction in related elements. Spacer tube 40A of said spacer means may have its inner diameter decreased to accept the projections of stud 50C and rod 60A without the need for bearings 40B and 40C. Therefore, the extremities of said spacer tube 40A will engage bearing 20B of said rotatable means and bearing 60C of said extensible means to transmit the axial force along support bar 10.

As previously stated, said extensible means comprises rod 60A coupled to third bearings 60B and 60C; with bearing 60C abutting bearing 40C of said spacer means and bearing 60B positioned against bearing 30B of tube 30A. Bearings 60B and 60C have securing means 60D and 60E internally enclosed and extending radially to secure said rod 60A thereby preventing movement of said bearings and said rod relative to their common axis.

As shown in FIGS. 1 and 2, tube 70A of covering means is the same diameter as tube 20A of rotatable means and extends longitudinally from its intersection with tube 20A to said retainer 50B; Tube 70A circumvents tube 30A of telescoping means. The extremities of tubes 20A and 70A enclose the longitudinal projections of said retainers 50A and 50B respectively; said tube extremities themselves being contained within the circumferences of sleeves 70B and 70C respectively of covering means, said covering means including said tube 70A.

When all components are assembled in their prescribed relationships with each other, support bar 10 is transformed into a telescoping support bar that can accommodate the varying plan dimensions of shower enclosures and similar facilities.

During installation of support bar 10 the distance is measured between walls 11 and 12 of FIG. 1. The installer removes retainer 50B, and telescoping means, consisting of tube 30A and fourth bearings 30B and 30C from the bar assembly shown in FIG. 2. Extensible means, comprising rod 60A and bearings 60B and 60C, having securing means 60D and 60E, is removed to set the required distance between bearings 60B and 60C. Securing means 60D and 60E are loosened and bearing means 60B and 60C moved longitudinally along rod 60A the distance required to bring the length of support bar 10 into compliance with the measured distance between walls 11 and 12 of FIG. 2; taking into account the compressibility of retainers 50A and 50B. Covering means comprising tube 70A and sleeves 70B and 70C are included in the installation process as the components previously removed are reassembled in reverse order. When support bar 10 is installed in the shower or other facility, sealing means 50E and 50F, attaching to retainers 50A and 50B respectively, engage walls 11 and 12.

Following the engagement of support bar 10 with walls 11 and 12; tube 20A of rotatable means is rotated about its longitudinal axis prompting mating threads of stud 50C and bearing 20B in FIG. 2 to facilitate longitudinal separation between first bearing 20B and retainer 50A, strongly forcing retainers 50A and 50B and sealing means 50E and 50F to grip walls 11 and 12. As rotatable means comprising tube 20A and first bearing 20B is rotated, the other components of support bar 10 remain stationary. The rotational energy applied to rotatable tube 20A is converted into a compressive axial force by threaded means of stud 50C and bearing 20B working together. The force is transmitted along longitudinal axis of support bar 10 as first bearing 20B presses against the end of tube 40A and second bearing 40B, said bearing securely engaging spacer tube 40A, said force traversing tube 40A to its opposite extremity to bearing 40C; said force being given to bearing 60C. Through the described connectivity of bearing 60C and rod 60A said force enters rod 60A and travels to bearing 60B through similar connective means previously described for bearing 60C. With third bearing 60B positioned against fourth bearing 30B, said force is received by telescoping means having fourth bearings 30B and 30C fixedly attaching to tube 30A of said telescoping means.

Tube 30A receives the force from bearing 60B through end of said tube and through fourth bearing 30B; said force passes to bearing 30C and retainer 50B through the mating surfaces of retainer 50B and bearing 30C. As shown by FIG. 1, wall 12 engages retainer 50B, having sealing means 50F; consequently, wall 12 receives said force from longitudinal axis of support bar 10 by means of retainer 50B and wall 11 by means or retainer 50A. As rotation of tube 20A continues, said force increases to attain its required magnitude creating a rigid, dominant, support bar between walls 11 and 12. With the decision to remove support bar 10, tube 20A is rotated in reverse until support bar 10 is adequately released from the holding force and becomes removable.

It is preferred that the materials of construction for the preferred embodiment be rust and corrosion resistant such as galvanized steel, stainless steel, plastic and rubber; each capable of providing the required characteristics for a specific use.

Thus there has been shown and described a telescoping support bar that fulfills all the objects and advantages sought after. Many changes modifications, variations and other uses and applications of the invention will, however, become apparent to those skilled in the art after considering this specification and accompanying drawing. All such changes, modifications, variations and other uses and applications which do not depart from the spirit and scope of the invention are deemed to be covered by the invention which is limited only by the claims which follow.

We claim:

1. A telescoping wall-to-wall support bar for installation in enclosures such as a shower or bath and shower combination; said support bar comprising retaining means with sealing means, rotatable means, spacer means, extensible means, telescoping means, and covering means in combination forming a longitudinal rigid assembly:

a) said retaining means comprising suction cups having a compressible, pliable material; and said sealing means engaging wall surfaces of one of said enclosures; said retaining means having a first retainer at one end of said telescoping support bar; said first retainer having a threaded stud mating with a threaded first bearing means of said rotatable means; and said retaining means having a second retainer at the opposite end of said telescoping support bar; said retainer means engaging the ends of the telescoping support bar to forcefully engage said wall surfaces of one of said enclosures; and b) said rotatable means comprising a first diameter tubular section circumferentially securing said threaded first bearing means; and having a longitudinal axis directionally oriented to receive a second diameter tubular section of said telescoping means to function as a telescoping unit; said rotatable means coupling with said retaining means through threads of said first bearing means mating with threads of said threaded stud of said first retainer; said first bearing means cooperating with said threaded stud of said first retainer to convert rotational motion of said first diameter tubular section into translational movement of said retaining means to generate compressive axial force traversing the longitudinal axis of said telescoping support bar and forcing said retaining means to engage said wall surfaces of one of said enclosures; and c) said spacer means being positioned in a spatial void between said first bearing means of said rotatable means and a third bearing means of said extensible means; said spacer means comprising a third tubular section circumventing and fixedly securing a plurality of second bearing means; one of said plurality of second bearing means providing passage for longitudinal projection of said threaded stud of said first retainer and a second one of said plurality of second bearing means providing passage for longitudinal projection of a rod of said extensible means; the ends of said third tubular section, in combination with said plurality of second bearing means, engaging surfaces of said first bearing means of said rotatable means and engaging surfaces of said third bearing means of said extensible means; and d) said extensible means comprising a plurality of said third bearing means encircling the longitudinal axis of said rod; said plurality of third bearing means having mobility along the longitudinal axis of said rod, said extensible means providing adjustability to the overall length of said telescoping support bar through movement of said plurality of third bearing means along the longitudinal axis of said rod; said extensible means comprising fastening means radically operable within said plurality of third bearing means to capture said rod and to lock said longitudinal movement of said plurality of third bearing means; and e) said telescoping means comprising a plurality of fourth bearing means, and said second diameter tublar section enclosing and fixedly securing said plurality of fourth bearing means; one of said plurality of fourth bearing means providing passage for longitudinal projection of said rod of said extensible means and a second one of said plurality of fourth bearing means providing passage for a stud of said second retainer of said retaining means; said second diameter tublar section having a radius smaller than the radius of said first diameter tubular section of said rotational means to permit said second diameter tubular section to axially translate in and out of the interior of said first diameter tubular section along the longitudinal axis of said telescoping support bar; and f) said covering means comprising a fourth tubular section adjacent said second retainer of said retaining means and directionally oriented with the longitudinal axis of said telescoping means; said fourth tubular section longitudinally encircling said second diameter tubular section; and said covering means comprising a plurality of sleeves; one of said plurality of sleeves circumventing said first retainer of said retaining means and an end of said first diameter tubular section adjacent said first retainer, and a second of said plurality of sleeves circumventing said second retainer of said retaining means and an end of said fourth tubular section adjacent said second retainer.

2. A telescoping wall-to-wall support bar for installation in enclosures such as a shower or bath and shower combination; said support bar comprising retaining means with sealing means, rotatable means, spacer means, extensible means, telescoping means, and covering means in combination forming a longitudinal rigid assembly:

a) said retaining means comprising disks having a compressible, pliable material; and said sealing means engaging wall surfaces of one of said enclosures; said retaining means having a first retainer at one end of said telescoping support bar; said first retainer having a threaded stud mating with a threaded first bearing means of said rotatable means; and said retaining means having a second retainer at the opposite end of said telescoping support bar; said retainer means engaging the ends of the telescoping support bar to forcefully engage said wall surfaces of one of said enclosures; and b) said rotatable means comprising a first diameter tubular section circumferentially securing said threaded first bearing means; and having a longitudinal axis directionally oriented to receive a second diameter tubular section of said telescoping means to function as a telescoping unit; said rotatable means coupling with said retaining means through threads of said first bearing means mating with threads of said threaded stud of said first retainer; said first bearing means cooperating with said threaded stud of said first retainer to convert rotational motion of said first diameter tubular section into translational movement of said retaining means to generate compressive axial force traversing the longitudinal axis of said telescoping support bar and forcing said retaining means to engage said wall surfaces of one of said enclosures; and c) said spacer means being positioned in a spatial void between said first bearing means of said rotatable means and a third bearing means of said extensible means; said spacer means comprising a third tubular section circumventing and fixedly securing a plurality of second bearing means; one of said plurality of second bearing means providing passage for longitudinal projection of said threaded stud of said first retainer and a second one of said plurality of second bearing means providing passage for longitudinal projection of a rod of said extensible means; the ends of said third tubular section, in combination with said plurality of second bearing means, engaging surfaces of said first bearing means of said rotatable means and engaging surfaces of said third bearing means of said extensible means; and d) said extensible means comprising a plurality of said third bearing means encircling the longitudinal axis of said rod; said plurality of third bearing means having mobility along the longitudinal axis of said rod, said extensible means providing adjustability to the overall length of said telescoping support bar through movement of said plurality of third bearing means along the longitudinal axis of said rod; said extensible means comprising fastening means radically operable within said plurality of third bearing means to capture said rod and to lock said longitudinal movement of said plurality of third bearing means; and e) said telescoping means comprising a plurality of fourth bearing means, and said second diameter tublar section enclosing and fixedly securing said plurality of fourth bearing means; one of said plurality of fourth bearing means providing passage for longitudinal projection of said rod of said extensible means and a second one of said plurality of fourth bearing means providing passage for a stud of said second retainer of said retaining means; said second diameter tublar section having a radius smaller than the radius of said first diameter tubular section of said rotational means to permit said second diameter tubular section to axially translate in and out of the interior of said first diameter tubular section along the longitudinal axis of said telescoping support bar; and f) said covering means comprising a fourth tubular section adjacent said second retainer of said retaining means and directionally oriented with the longitudinal axis of said telescoping means; said fourth tubular section longitudinally encircling said second diameter tubular section; and said covering means comprising a plurality of sleeves; one of said plurality of sleeves circumventing said first retainer of said retaining means and an end of said first diameter tubular section adjacent said first retainer, and a second of said plurality of sleeves circumventing said second retainer of said retaining means and an end of said fourth tubular section adjacent said second retainer.

* * * * *